US006635895B2

(12) United States Patent
Haque et al.

(10) Patent No.: US 6,635,895 B2
(45) Date of Patent: Oct. 21, 2003

(54) EDGE SCAN SENSOR FOR WEB GUIDING APPARATUS

(75) Inventors: Md. M. Haque, Edmond, OK (US); Jim Yates, Oklahoma City, OK (US); Darcy Winter, Oklahoma City, OK (US); Steven Schmidt, Tuttle, OK (US); Dale Hueppelsheuser, Jones, OK (US); Greg A. Storie, Oklahoma City, OK (US)

(73) Assignee: Fife Corporation, Oklahoma City, OK (US)

( * ) Notice: Subject to any disclaimer, the term of this patent is extended or adjusted under 35 U.S.C. 154(b) by 194 days.

(21) Appl. No.: 09/947,721

(22) Filed: Sep. 6, 2001

(65) Prior Publication Data

US 2002/0027208 A1 Mar. 7, 2002

Related U.S. Application Data

(60) Provisional application No. 60/231,172, filed on Sep. 7, 2000.

(51) Int. Cl.[7] ..... G01N 21/86; G01V 8/00

(52) U.S. Cl. ..... 250/559.36; 356/637

(58) Field of Search ..... 250/559.36, 559.29, 250/559.19; 356/625, 635, 637; 340/675, 676

(56) References Cited

U.S. PATENT DOCUMENTS 5,120,976 A * 6/1992 Clayton et al. ..... 250/559.36

OTHER PUBLICATIONS

Erhardt + Leimer Inc. manual; Infra–red edge sensor FR 5001 / FR 5021.

* cited by examiner

*Primary Examiner*—Walter E. Snow
(74) *Attorney, Agent, or Firm*—Dunlap, Codding & Rogers, P.C.

(57) ABSTRACT

A sensor system for determining the position of an edge of a moving web of material travelling along a predetermined travel path. the sensor system comprising a transmitter/receiver assembly, a beam reflector assembly and sensor signal processing. The transmitter/receiver assembly is positioned adjacent to the travel path of the moving web of material. The transmitter/receiver assembly has a transmitter transmitting a light curtain across at least a portion of the travel path, and a receiver receiving a shifted light curtain transmitted across at least a portion of the travel path and generating video output signals indicative of the position of the edge of the moving web of material. The beam reflector assembly is also positioned adjacent to the travel path of the moving web of material such that the travel path passes between the transmitter/receiver assembly and the beam reflector assembly. The beam reflector assembly receives an unblocked portion of the light curtain, shifts the unblocked portion of the light curtain a distance laterally to form the shifted light curtain, and transmits the shifted light curtain across the travel path of the moving web of material.

20 Claims, 4 Drawing Sheets

| i | NO WEB $Vmax_i$ | FULLY COVERED $Vmin_i$ |
|---|---|---|
| 0 | $Vmax_0$ | $Vmin_0$ |
| 1 | $Vmax_1$ | $Vmin_1$ |
| 2 | $Vmax_2$ | $Vmin_2$ |
| . | . | . |
| . | . | . |
| . | . | . |
| . | . | . |
| . | . | . |
| . | . | . |
| n | $Vmax_n$ | $Vmin_n$ |

FIG. 2

EDGE SCAN SENSOR FOR WEB GUIDING APPARATUS

CROSS-REFERENCE TO RELATED APPLICATIONS

The present patent application claims priority to the provisional patent application identified by U.S. Ser. No. 60/231,172, filed on Sep. 7, 2000, the entire content of which is hereby expressly incorporated herein by reference.

STATEMENT REGARDING FEDERALLY SPONSORED RESEARCH AND DEVELOPMENT

Not Applicable.

BRIEF DESCRIPTION OF THE SEVERAL VIEWS OF THE DRAWING

FIG. 2 is a table illustrating maximum and minimum values for each pixel in a receiver utilized in the web guiding apparatus of FIG. 1.

DETAILED DESCRIPTION OF THE INVENTION

Figure 1:
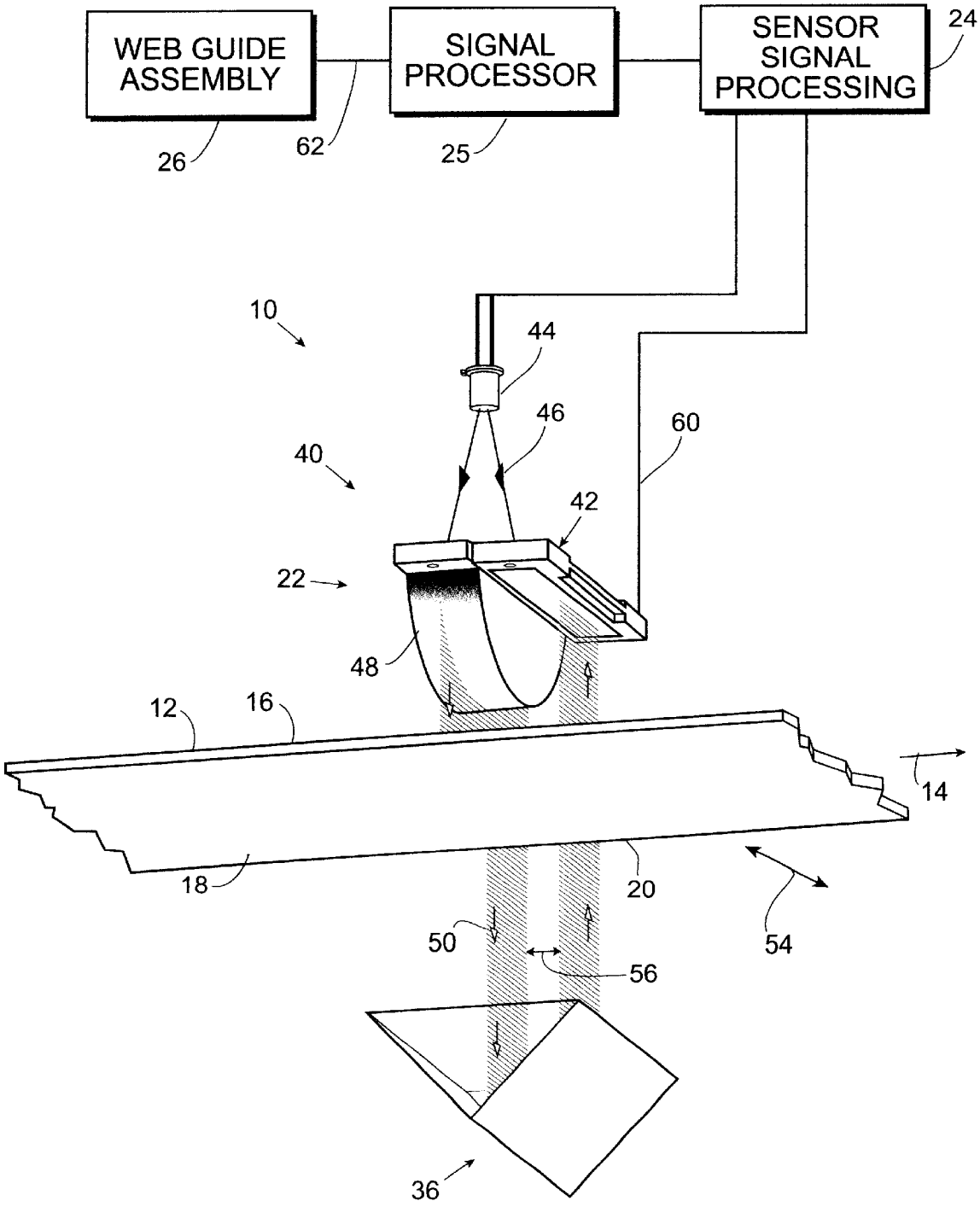
FIG. 1 is a partial perspective, diagrammatic view of a web guiding apparatus, constructed in accordance with the present invention, for guiding a continuous web of material traveling along a predetermined travel path.

Referring now to FIG. 1, shown therein is a web guiding apparatus 10, constructed in accordance with the present invention, for guiding a moving web of material 12 traveling along a predetermined travel path 14. The web of material 12 has a first side 16, an opposed second side 18 and at least one edge 20. The web of material 12 can be an opaque material, a non-woven material having varying opacities, or a substantially transparent material. An example of a "non-woven" material is the material commonly utilized to manufacture diapers.

In general, the web guiding apparatus 10 is provided with a sensor system 22, a signal processor 25, and a web guide assembly 26.

The sensor system 22 determines the position of the edge 20 of the web of material 12. In general, the sensor system 22 is provided with a sensor signal processing 24, a transmitter/receiver assembly 34 and a beam reflector assembly 36.

The beam reflector assembly 36 is disposed adjacent to the second side 18 of the web of material 12 and is spaced a distance from the transmitter/receiver assembly 34. Thus, the travel path 14 of the web of material 12 passes between the beam reflector assembly 36 and the transmitter/receiver assembly 34.

The transmitter/receiver assembly 34 is provided with a transmitter 40 and a receiver 42. The transmitter 40 includes a light source 44 for outputting a light beam 46 (as represented by the arrows) and a lens assembly 48 for receiving the light beam 46 and converting the light beam 46 into a light curtain 50. The light source 44 can be any suitable light source for generating a light beam which can be projected across the travel path 14 of the web of material 12 and reflected to the receiver 42 by the beam reflector assembly 36. In one preferred embodiment, the light source 44 is an infrared L.E.D.

The lens assembly 48 transmits the light curtain 50 across at least a portion of the travel path 14. The lens assembly 48 can be any lens assembly capable of converting the light beam 46 into the light curtain 50. For example, the lens assembly 48 can be a piano convex lens, or a cross-cylindrical aspherical lens set.

The receiver 42 is disposed adjacent to the first side 16 of the web of material 12 and is offset laterally from the lens assembly 48 of the transmitter 40. The receiver 42 generates video output signals in response to receiving at least a portion of the light curtain 50 transmitted by the lens assembly 48 of the transmitter 40. That is, as the web of material 12 moves a distance 54 laterally between the transmitter/receiver assembly 34 and the beam reflector assembly 36, the amount of the light curtain 50 blocked by the web of material 12 changes. The unblocked portion of the light curtain 50 is used to determine the position of the edge 20 of the web of material 12.

The receiver 42 is desirably a linear photodiode array having a plurality of photodiodes. Each of the photodiodes forms one pixel of the linear photodiode array. The receiver 42 may also be formed of a Charged Coupled Device (CCD).

The beam reflector assembly 36 receives the light curtain 50 and shifts the light curtain 50 a distance 56 laterally. The shifted light curtain 50 is transmitted by the beam reflector assembly 36 across the travel path 14 of the web of material 12 to the receiver 42. Thus, the light curtain 50 passes across the travel path 14 of the web of material 12 twice; once when passing from the lens assembly 48 to the beam reflector assembly 36 and once when passing from the beam reflector assembly 36 to the receiver 42.

In one preferred embodiment, the light curtain 50 is folded back approximately 180 degrees by the beam reflector assembly 36. As a result, the light curtain 50 forms two spaced-apart parallel paths crossing the web of material 12. This method provides higher signal to noise ratio than the traditional method of using a beam splitter, i.e., 50% mirror, in conjunction with a retroreflector where the return light uses the same path thereby losing 75% of the signal strength.

It should be noted that the light curtain 50 passing across the travel path 14 of the web of material 12 twice tends to average out variations in the opacity of the web of material 12 to provide a more accurate video output signal which is similar to the video output signal produced when the web of material 12 is opaque. When the web of material 12 has a nonuniform opacity (such as is the case for non-woven material and substantially transparent material), this averaging effect improves the video output signal to permit more accurate detection of the edge 20 of the web of material 12 than a single passing of the light curtain 50 past the travel path 14 of the web of material 12.

The beam reflector assembly 36 can be formed of a right angle prism. Alternatively, the beam reflector assembly 36 can be formed of two front surface mirrors mounted at an angle with respect to each other. The angle that the two mirrors are mounted can vary widely, but is desirably ninety degrees so that the transmitter 40 and the receiver 42 of the transmitter/receiver assembly 34 can be mounted side-by-side.

The receiver 42 receives the light curtain 50 and generates video output signals which are indicative of the position of the edge 20 of the web of material 12. The video output signals are transmitted to the sensor signal processing 24 via a signal path 60. The sensor signal processing 24 receives the video output signals and processes the video output signals to determine the locations of the edge 20 of the web of material 12.

Figure 4:
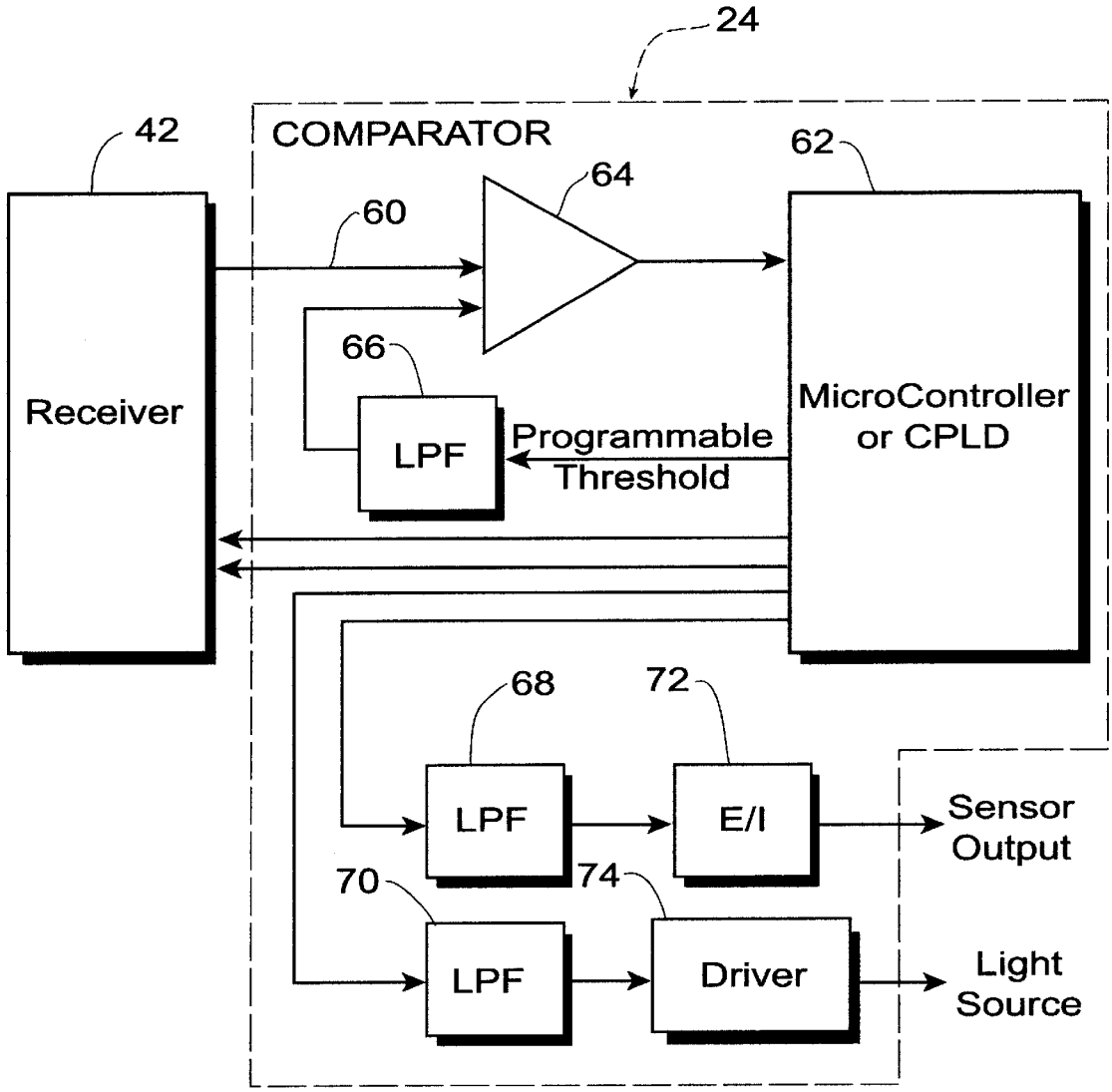
FIG. 4 is a block diagram of a sensor signal processing of the web guiding apparatus depicted in FIG. 1.

The sensor signal processing 24 is shown in more detail in FIG. 4. The sensor signal processing 24 includes a microcontroller 62 or CPLD, along with a comparator 64, a first low pass filter 66, a second low pass filter 68, a third low pass filter 70, a voltage to current converter 72 and a drive circuitry 74 (for the light source 44). To locate the position of the edge 20 of the web of material 12, the microcontroller 62is programmed to generate a programmable threshold. The programmable threshold is provided to the comparator 64 via the first low pass filter 66. Thus, the comparator 64 compares the output of every pixel in the receiver 42 to a predetermined threshold value represented by the programmable threshold. If the output of a pixel is less than the predetermined threshold value, then the comparator 64 of the sensor signal processing 24 determines that the pixel is fully covered by the web of material 12. Likewise, if the output of a pixel is greater than the predetermined threshold value, then the comparator 64 of the sensor signal processing 24 determines that the pixel is uncovered by the web of material 12. The transition from fully covered to uncovered in the output signals generated by the pixels is indicative of the location of the edge 20 of the web of material 12.

The microcontroller 62 also supplies control signals to drive the receiver 42. For example, the control signals can be a pixel clock and a serial clock inputs. In addition, the microcontroller 62 provides a light source control signal (which in one preferred embodiment is a PWM signal) to the light source 44 via the third low pass filter 70 and the drive circuitry 74. The light source control signal controls the intensity of the light source 44. Sensor output signals indicative of the position of the edge 20 of the web of material 12 are provided to the signal processor 25 via the second low pass filter 68 and the voltage to current converter 72. For example, the sensor output signal provided to the signal processor 25 can be a current output in a range from 0 ma to 10 ma where 0 ma indicates an uncovered sensor field of view and 10 ma indicates a fully covered sensor field of view.

The signal processor 25 receives the sensor output signals and compares the sensor output signals in real-time to a set point to generate error signals responsive to the sensor output signals produced by the sensor signal processing 24 for automatically correcting a deviation from a predetermined position of the web of material 12. The error signals are output to the web guide assembly 26 via a signal path 80 for guiding the web of material 12.

The web guide assembly 26 can be a conventional offset web guiding system provided with a base, a platform and a platform drive assembly. In general, the platform is pivotally mounted on the base to pivot about a pivot range. At least one steering roller is mounted on the platform and is disposed transversely of the travel path 14 of the web of material 12 when the web of material 12 travels across the platform. The platform drive assembly is responsive to the control signals generated by the signal processor 25 for pivoting the platform and thereby controlling the angular position of the platform relative to the base. Offset web guiding assemblies are well known in the art and a detailed description of such offset web guiding assemblies is not deemed necessary to teach one skilled in the art to make and use the present invention.

As will be understood by those of ordinary skill in the art, the sensor system 22 of the present invention can be used for determining the position of one edge 20 of the web of material 12 or two edges of the web of material 12. For example, as shown in FIG. 1, one sensor system 22 can be mounted adjacent to the edge 20 of the web of material 12 for determining the position of the edge 20 of the web of material 12. Alternatively, the web of material 12 can have a width less than the width of the light curtain 50 produced by the transmitter 40. In this example, the web of material 12 can be guided through a central portion of the light curtain 50 such that unblocked portions of the light curtain 50 extend along both edges of the web of material 12.

The sensor system 22 can also be utilized for determining the locations of both edges of the web of material 12 by positioning one sensor system 22 adjacent to each edge of the web of material 12. The two sensor systems 22 can be mounted on a moving sensor center guide positioner assembly, a fixed sensor center guide positioner assembly or a fixed edge guide sensor positioner assembly. The moving sensor center guide positioner assembly, the fixed sensor center guide positioner assembly and the fixed edge guide sensor positioner assembly are well known in the art. Thus, a detailed description of the moving sensor center guide positioner assembly, the fixed sensor center guide positioner assembly, and the fixed edge guide sensor positioner assembly is not deemed necessary to teach one skilled in the art to make and use the present invention.

For ambient light immunity, a first filter (not shown) is placed in between the receiver 42 and the beam reflector assembly 36. The first filter is capable of passing the light curtain 50 while preventing the passage of other light therethrough so as to provide the ambient light immunity for the receiver 42. For example, in one preferred embodiment the first filter is an infrared light filter including an integral horizontal light control film. A suitable light filter including an integral horizontal light control film can be obtained from 3M.

A transparent film with vertical light control film can also be used in conjunction with the first filter to provide a matrix grid to prevent stray lights from interfering with the receiver 42. In other words, the only light which is passed through the first filter and the transparent film is the light curtain 50.

When the web of material 12 is a transparent, or substantially transparent material, the output of the receiver 42 of the sensor system 22 should be normalized so as to exaggerate or amplify the signals detected by the receiver 42. As shown in FIG. 2, the sensor system 22 is calibrated by learning the maximum and minimum values for each pixel in the receiver 42. The maximum value for each pixel corresponds to the condition where the web of material 12 is not disposed in between the transmitter/receiver assembly 34 and the beam reflector assembly 36. The minimum values for each pixel corresponds to the condition where the web of material 12 is disposed in between the transmitter/receiver assembly 34 and the beam reflector assembly 36. Thus, the maximum and minimum values for each pixel in the receiver 42 can be determined by selectively positioning the web of material 12 between the transmitter/receiver assembly 34 and the beam reflector assembly 36.

A table including the maximum and minimum values for each pixel is stored in the microcontroller 62 of the sensor signal processing 24 and utilized by the sensor signal processing 24 in real-time to generate the control signals transmitted to the web guide assembly 26 for guiding the web of material 12. The following formula can be used to normalize the output signals detected by the receiver 42 with the maximum and the minimum values in the table stored in the sensor signal processing 24:

$$\text{Normalized Pixel Value}=(V_{max}(i)-V(i))/(V_{max}(i)-V_{min}(i)),$$

where

V(i) is the output signal detected by each individual pixel;

Vmax(i) is the maximum value for each individual pixel stored in the table; and

Vmin(i) is the minimum value for each individual pixel stored in the table.

An alternative formula for normalizing the output signals detected by the receiver 42 with the maximum and the minimum values in the table stored in the sensor signal processing 24 is:

$$\text{Normalized Pixel Value}=(V((i)-V_{min}(i))/(V_{max}(i)-V_{min}(i))$$

The sensor signal processing 24 is programmed to compare the normalized pixel value to a predetermined threshold value. If the normalized pixel value is less than the predetermined threshold value, then the sensor signal processing 24 determines that the pixel is fully covered by the transparent web of material 12. Likewise, if the normalized pixel value is greater than the predetermined threshold value, then the sensor signal processing 24 determines that the pixel is uncovered by the web of material 12. The transition from fully covered to uncovered in the output signals generated by the pixels is indicative of the location of the edge 20 of the web of material 12.

In one embodiment, digital processing of the video signal by the sensor signal processing 24 creates the output of the sensor system 22 based upon the edge 20 of the web of material 12 as opposed to an output based upon the total amount of light received. The edge 20 is thus threshold-based and creates immunity to any opacity variations in the web of material 12 and can even disregard small holes in the material after the edge 20 has been found.

As an optional feature, the sensor signal processing 24 can create a logical pixel filter to aid in the locating of the edge 20. The logical pixel filter includes a predetermined number of adjacent pixels, such as 3, 4 or 5 pixels. To determine whether a transition in the video signal is indicative of the edge 20 of the web of material 12, the number of pixels remaining low following the transition must be greater than the number of pixels determined by the logical pixel filter. Otherwise, the transition is not determined to be indicative of the edge 20 of the web of material 12. If the transition is determined to be indicative of the edge 20, the output of the sensor system 22 is updated and any further transitions in the video signal are ignored.

Figure 3:
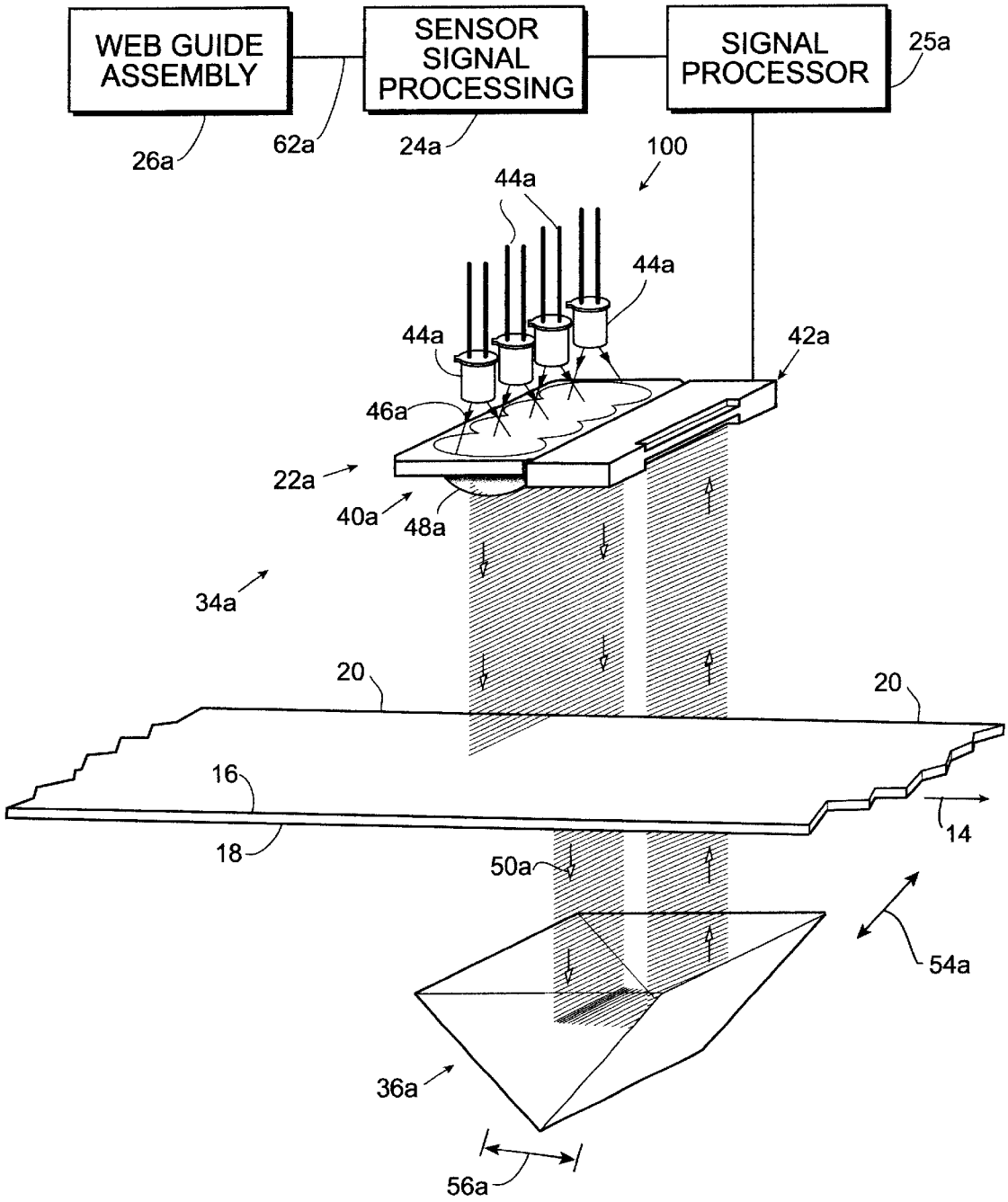
FIG. 3 is a partial perspective, diagrammatic view of another embodiment of a web guiding apparatus incorporating features of the present invention.

Referring now to FIG. 3, shown therein is another embodiment of a web guiding apparatus 100, constructed in accordance with the present invention, for guiding the web of material 12 through the travel path 14. For purposes of brevity, similar elements of the web guiding apparatus 100 shown in FIG. 3 and the web guiding apparatus 10 are labeled with the same numeric prefix, and an alphabetical suffix "a". The web guiding apparatus 100 and the web guiding apparatus 10 are similar in construction and function, except that the sensor system 22*a* includes a plurality of light sources 44*a*, and a plurality of lens assemblies 48*a* cooperating to form a light curtain 50*a*.

It should be understood that the foregoing simply sets forth examples of the various inventive concepts contemplated herein. Thus, changes may be made in the embodiments of the invention described herein, or in the parts or the elements of the embodiments described herein, or in the steps or sequence of steps of the methods described herein, without departing from the spirit and/or the scope of the invention as defined in the following claims.

What is claimed is:

1. A sensor system for determining the position of an edge of a moving web of material traveling along a predetermined travel path, the web of material having a first side, an opposed second side and at least one edge, the sensor system comprising:

a transmitter/receiver assembly positionable adjacent to the travel path of the moving web of material, the transmitter/receiver assembly comprising:

a transmitter transmitting a light curtain across at least a portion of the travel path; and a receiver receiving a shifted light curtain transmitted across at least a portion of the travel path and generating video output signals indicative of the position of the edge of the moving web of material;

a beam reflector assembly positionable adjacent to the travel path of the moving web of material such that the travel path passes between the transmitter/receiver assembly and the beam reflector assembly, the beam reflector assembly receiving an unblocked portion of the light curtain, shifting the unblocked portion of the light curtain a distance laterally to form the shifted light curtain, and transmitting the shifted light curtain across the travel path of the moving web of material; and a sensor signal processing receiving the video output signals and processing the video output signals to determine the location of the edge of the web of material.

2. The sensor system of claim 1, wherein the receiver includes a light source outputting a light beam, and a lens assembly receiving the light beam and converting the light beam into the light curtain.

3. The sensor system of claim 2, wherein the lens assembly includes a piano convex lens.

4. The sensor system of claim 2, wherein the light source includes a light emitting diode.

5. The sensor system of claim 1, wherein the transmitter and the receiver are mounted side-by-side.

6. The sensor system of claim 1, wherein the beam reflector assembly folds the unblocked portion of the light curtain back approximately 180 degrees such that the light curtain and the shifted light curtain form two spaced-apart parallel paths crossing the travel path of the web of material.

7. The sensor system of claim 6, wherein the beam reflector assembly includes a right angle prism.

8. The sensor system of claim 6, wherein the beam reflector assembly includes two front surface mirrors mounted at an angle with respect to each other.

9. The sensor system of claim 8, wherein the angle is ninety degrees.

10. The sensor system of claim 1, wherein the receiver includes a plurality of pixels, and the sensor signal processing includes a table of maximum and minimum values for each pixel, the table being used in real-time to generate control signals for guiding the web of material.

11. A web guiding apparatus for guiding a moving web of material travelling along a predetermined travel path, the web of material having a first side, an opposed second side and at least one edge, the web guiding apparatus comprising:

a sensor system, comprising:

a transmitter/receiver assembly positionable adjacent to the travel path of the moving web of material, the transmitter/receiver assembly comprising:

a transmitter transmitting a light curtain across at least a portion of the travel path; and a receiver receiving a shifted light curtain transmitted across at least a portion of the travel path and generating video output signals indicative of the position of the edge of the moving web of material;

a beam reflector assembly positionable adjacent to the travel path of the moving web of material such that the travel path passes between the transmitter/receiver assembly and the beam reflector assembly, the beam reflector assembly receiving an unblocked portion of the light curtain, shifting the unblocked portion of the light curtain a distance laterally to form the shifted light curtain, and transmitting the shifted light curtain across the travel path of the moving web of material; and a sensor signal processing receiving the video output signals and processing the video output signals to determine the location of the edge of the web of material, the sensor signal processing outputting signals indicative of the location of the edge of the web of material; and a web guiding assembly receiving error signals based on the signals output by the sensor signal processing for guiding the web of material.

12. The web guiding apparatus of claim 11, wherein the receiver includes a light source outputting a light beam, and a lens assembly receiving the light beam and converting the light beam into the light curtain.

13. The web guiding apparatus of claim 12, wherein the lens assembly includes a piano convex lens.

14. The web guiding apparatus of claim 12, wherein the light source includes a light emitting diode.

15. The web guiding apparatus of claim 11, wherein the transmitter and the receiver are mounted side-by-side.

16. The web guiding apparatus of claim 11, wherein the beam reflector assembly folds the unblocked portion of the light curtain back approximately 180 degrees such that the light curtain and the shifted light curtain form two spaced-apart parallel paths crossing the travel path of the web of material.

17. The web guiding apparatus of claim 16, wherein the beam reflector assembly includes a right angle prism.

18. The web guiding apparatus of claim 16, wherein the beam reflector assembly includes two front surface mirrors mounted at an angle with respect to each other.

19. The web guiding apparatus of claim 18, wherein the angle is ninety degrees.

20. The web guiding apparatus of claim 11, wherein the receiver includes a plurality of pixels, and the sensor signal processing includes a table of maximum and minimum values for each pixel, the table being used in real-time to generate control signals for guiding the web of material.

* * * * *

UNITED STATES PATENT AND TRADEMARK OFFICE

CERTIFICATE OF CORRECTION

PATENT NO. : 6,635,895 B2
DATED : October 21, 2003
INVENTOR(S) : M. Haque et al.

It is certified that error appears in the above-identified patent and that said Letters Patent is hereby corrected as shown below:

Column 2,
Line 8, delete the word “piano” and substitute therefore the word -- plano --.

Column 3,
Line 13, insert a space after the numeral “62” and before the word “is”.

Column 6,
Line 39, delete the word “piano” and substitute therefore the word -- plano --.

Column 8,
Line 4, delete the word “piano” and substitute therefore the word -- plano --.

Signed and Sealed this

Sixth Day of July, 2004

JON W. DUDAS
*Acting Director of the United States Patent and Trademark Office*